US010367272B2

(12) United States Patent
Witte et al.

(10) Patent No.: US 10,367,272 B2
(45) Date of Patent: Jul. 30, 2019

(54) SPRING-LOADED CLAMPING CONNECTION

(71) Applicant: WAGO VERWALTUNGSGESELLSCHAFT MBH, Minden (DE)

(72) Inventors: Thomas Witte, Porta Westfalica (DE); Muhammet Ali Tuerkekoele, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/283,237

(22) Filed: Feb. 22, 2019

(65) Prior Publication Data

US 2019/0190168 A1 Jun. 20, 2019

Related U.S. Application Data

(63) Continuation of application No. PCT/EP2017/070839, filed on Aug. 17, 2017.

(30) Foreign Application Priority Data

Aug. 23, 2016 (DE) ..... 10 2016 115 601

(51) Int. Cl.
*H01R 13/62* (2006.01)
*H01R 4/48* (2006.01)

(52) U.S. Cl.
CPC ..... *H01R 4/4845* (2013.01); *H01R 4/4836* (2013.01)

(58) Field of Classification Search
CPC ..... H01R 13/62938; H01R 13/6633; H01R 13/62933; H01R 13/658
(Continued)

(56) References Cited

U.S. PATENT DOCUMENTS 4,406,509 A * 9/1983 Jagen ..... H01R 13/26 439/354
6,532,653 B1 * 3/2003 Alpert ..... H01R 13/72 29/876
(Continued)

FOREIGN PATENT DOCUMENTS

DE 102004045026 B3 2/2006
DE 102006018129 B4 12/2007
(Continued)

OTHER PUBLICATIONS

International Search Report dated Oct. 19, 2017 in corresponding application PCT/EP2017/070839.
(Continued)

*Primary Examiner* — Phuong Chi T Nguyen
(74) *Attorney, Agent, or Firm* — Muncy, Geissler, Olds & Lowe, P.C.

(57) ABSTRACT

A spring-loaded clamping connection for clamping an electrical conductor, having an insulating-material housing, a bus bar and a clamping spring. The clamping spring has a contact limb, a spring bow, a clamping limb and an operating section. The clamping limb has a clamping edge. The clamping edge forms, with the busbar, a clamping point for clamping the electrical conductor between the clamping edge and the busbar. An operating element is movably mounted in the insulating-material housing and designed to apply force to the operating section. The operating element is mounted in the insulating-material housing in a linearly displaceable manner and extends from the operating section of the clamping spring beyond a plane which is spanned by the bearing surface of the contact limb on the bus bar or on the insulating-material housing.

31 Claims, 16 Drawing Sheets

(58) Field of Classification Search
USPC ..... 439/157, 160, 372, 607.55
See application file for complete search history.

(56) References Cited

U.S. PATENT DOCUMENTS

| | | | | |
|---|---|---|---|---|
| 8,376,630 | B2 * | 2/2013 | Wang | G02B 6/3817 385/139 |
| 8,388,387 | B2 | 3/2013 | Koellmann | |
| 8,777,650 | B1 * | 7/2014 | Lin | H01R 13/514 439/345 |
| 9,397,444 | B1 | 7/2016 | Wu | |
| 10,033,119 | B2 | 7/2018 | Koellmann | |
| 2011/0131805 | A1 * | 6/2011 | Abughazaleh | H05K 1/18 29/842 |
| 2014/0364001 | A1 * | 12/2014 | Kraus | H01R 13/6272 439/358 |
| 2015/0093925 | A1 | 4/2015 | Bruchmann | |
| 2015/0132975 | A1 * | 5/2015 | Yossef | H01R 24/64 439/49 |
| 2016/0020543 | A1 | 1/2016 | Tedeschi | |

FOREIGN PATENT DOCUMENTS

| | | | |
|---|---|---|---|
| DE | 202009002324 | U1 | 7/2010 |
| DE | 102013110789 | B3 | 12/2014 |
| DE | 202015103176 | U1 | 6/2015 |
| DE | 102014119421 | A1 | 6/2016 |
| EP | 2234211 | A1 | 9/2010 |
| EP | 2400595 | A1 | 12/2011 |
| EP | 2849287 | A1 | 3/2015 |
| JP | H1012294 | A | 1/1998 |

OTHER PUBLICATIONS

International Preliminary Report on Patentability dated Feb. 26, 2019 in corresponding application PCT/EP2017/070839.

* cited by examiner c b a

SPRING-LOADED CLAMPING CONNECTION

This nonprovisional application is a continuation of International Application No. PCT/EP2017/070839, which was filed on Aug. 17, 2017, and which claims priority to German Patent Application No. 10 2016 115 601.9, which was filed in Germany on Aug. 23, 2016, and which are both herein incorporated by reference.

BACKGROUND OF THE INVENTION

Field of the Invention

The present invention relates to spring-loaded terminal/clamping connection, in particular a spring-loaded terminal for connecting an electrical conductor, having an insulating housing, having a busbar, and having a clamping spring that has a contact leg, a spring bend, a clamping leg, and an operating section, wherein the clamping leg has a clamping edge, and the clamping edge forms, together with the busbar, a clamping point for clamping the electrical conductor between the clamping edge and the busbar, and having an operating element that is movably mounted in the insulating housing and is designed to apply a force to the operating section.

Description of the Background Art

Spring-loaded terminals of the initially mentioned type are known in a multitude of forms.

EP 2 400 595 A1, which corresponds to U.S. Pat. No. 8,388,387, which is incorporated herein by reference, and which shows a connecting terminal having an insulating housing and having at least one spring terminal unit with a clamping spring and a busbar section in the insulating housing. An operating lever is provided that is pivotably arranged in the insulating housing and that, when displaced, exerts a tensile force on the clamping spring acting in opposition to the spring force. In an embodiment, a movable lug that is formed as a single piece with the insulating housing is provided that delimits an operating passage for an operating tool, and is suspended in an operating section of a leg spring. The clamping point between the leg spring and a busbar can be opened by tilting the operating tool that rests against the insulating lug about an opposing fulcrum on the insulating housing.

EP 2 234 211 A1 discloses a spring-loaded connection for an electrical conductor, having a slide that is supported so as to be linearly movable in an insulating housing and that can be moved in the longitudinal direction relative to the contact limb of the contact body for opening at the clamping point. For this purpose, the slide has, at its end facing the interior of the housing, a deflecting ramp that works together with the clamping arm of the contact spring. The externally accessible slide can be moved into the interior of the housing by pressing with a finger, and has openings to receive electrical conductors.

A similar embodiment of a spring force terminal having a pusher that can move linearly into the interior of the insulating housing is described in DE 10 2006 018 129 B4. To optimize the ratio between the travel distance of the opener and the pivoting distance of the clamping leg, an operating leg, on which is located the region that the opener acts upon, is arranged on the side of the clamping leg.

DE 10 2013 1 10 789 B3, which corresponds to US 2015/0093925 shows an adapter for contacting busbars. A connecting structure is provided that presses on spring terminals and is moved with the aid of a common lever switch.

SUMMARY OF THE INVENTION

It is therefore an object of the present invention to provide an improved spring-loaded terminal/clamping connection.

In an exemplary embodiment, an operating element is mounted in the insulating housing so as to be linearly movable, and extends from the operating section of the clamping spring beyond a plane spanned by the support surface of the contact leg on the busbar or on the insulating housing. The operating element is designed to apply a force to the operating section of the clamping spring on the side of the operating section facing away from the support surface of the contact leg on the busbar.

In this way, a spring-loaded terminal can be created that is very compact and is optimized with regard to the action of the operating force. In this design, opening of the clamping spring can be accomplished by engaging beneath or behind the operating section in the pulling direction of the clamping spring so that the linearly movable operating element moves the clamping leg toward the contact leg upon displacement of the operating lever, for example by pivoting. The linearly movable operating element in this design can be guided past the clamping spring, for example to the side, or also, as appropriate, in front of or behind the clamping spring, and extends from the operating section of the clamping spring beyond a plane spanned by the support surface of the contact leg on the busbar or by the insulating housing. In this way, an operating lever that is, e.g., pivotable, which is positioned on the side of the spring-loaded terminal diametrically opposite the operating leg, can act on the operating element.

The operating element can be guided in a linearly movable fashion by guide contours in the insulating housing and/or the clamping spring. In this design, the guide can be delimited by stops in order to avoid excessive deflection of the clamping leg.

The operating element can have a bearing section for an operating lever. The bearing section and the support surface are matched to one another such that the operating element can be displaced linearly, for example by pivoting the operating lever that is supported on the support surface of the insulating housing and braced against the bearing section of the operating element. A free space for receiving the operating lever, delimited by a support surface of the insulating housing, may be present between the bearing section and the insulating housing.

The operating lever in this design can be a part that is pivotably connected to the operating element, or can also be a separate operating tool that can be inserted into the spring-loaded terminal as needed.

The bearing that connects the operating lever to the operating element can be designed as a pivot bearing for the operating lever. As a result, the operating lever is provided as a functional component of the spring-loaded terminal. This operating lever can be, for example, a pivoted lever made of an insulating material that is coupled to the operating element by the pivot bearing. The position of this pivot bearing is then matched to the operating lever and operating element such that the operating element is displaced linearly when the operating lever is pivoted. The insulating housing provides a support surface for the operating lever, which surface acts as a counter bearing.

Such an operating lever can have a lever arm section and a pressure arm section, which project out from the pivot bearing in different directions.

The lever arm section and the pressure arm section can project in opposite directions. The pressure arm section can then extend at an obtuse angle (greater than 90°) to the longitudinal axis of the lever arm section, which passes through the pivot bearing. This has the advantage that the pressure arm section, which interacts with the support surface of the insulating housing, is not simply located opposite the free arm of the lever arm section, but instead is directed out of a straight line with the lever arm section toward the support surface. This permits a very compact embodiment with optimized force transmission in which operation is accomplished by exerting a tensile force on the lever arm section.

The lever arm section and the pressure arm section can be located on the same side of the pivot bearing, which is to say they can extend away from the pivot bearing on the same side of the operating element. The pressure arm section is then at an acute angle (less than 90°) to the longitudinal axis of the lever arm section, which passes through the pivot bearing. This permits an even more compact embodiment with force transmission in which operation is accomplished by exerting a compressive force on the lever arm section.

The operating lever can have a plain bearing support contour for forming a plain bearing with the support surface of the insulating housing. This support contour can be, e.g., a rounded/curved contour or an angular contour, with which the contact area is reduced as compared to a full-area support. This ensures that the operating lever that is coupled to the operating element by the pivot bearing slides along the support surface upon pivoting in order to achieve linear displacement of the operating element.

The operating lever can be a (separate) operating tool that can be inserted into the free space. The operating element then has a bearing surface located opposite the support surface of the insulating housing. The support surface and the bearing surface are arranged to be offset from one another in the direction of extent of the operating tool inserted into the free space. For such a separate operating tool, as for example a screwdriver, a bearing is provided for linear displacement of the operating element upon pivoting of the operating tool, on the one hand by the support surface of the insulating housing and on the other hand by a bearing surface on the operating element located opposite the support surface. The free space for receiving an operating tool is then located between this pair of support and bearing surfaces that are offset from one another.

The operating element can have a guide wall located laterally next to the clamping spring and mounted on the insulating housing so as to be linearly movable, and can have a finger projecting under the operating section from the guide wall. The finger is arranged so as to come to rest against the operating section on the side of the operating section facing away from the contact leg, and to move the operating section toward the contact leg of the clamping spring by the application of force.

The term "under" can be understood in this context to mean on a side facing away from the contact leg.

The clamping spring can be a leg spring bent into a U-shape. The operating section of the clamping spring is then located at a distance from the clamping edge on the clamping leg, or is connected to the clamping leg. The operating section thus acts on the clamping leg, moving the clamping leg by the application of force to the operating section such that the clamping point formed by the clamping edge and the busbar for clamping an electrical conductor is opened.

The operating section of the clamping spring can be formed on a lug projecting laterally from the clamping leg. In this way, the operating section forms a part that is integrally connected to the clamping leg and projects laterally from the clamping leg.

The operating section of the clamping spring can also be designed as a frame element, however. The frame element can be composed of a side bar and a crossbar projecting from the side bar. The frame element can also have two side bars connected to the clamping leg and spaced apart from one another, and a crossbar connecting the side bars. A clamping tab equipped with the clamping edge projects from the clamping leg between the side bars in this design. The crossbar is then ahead of and/or behind the clamping edge in the insertion direction. The frame element is thus formed from the clamping leg. The clamping tab, which bears the clamping edge, is then aligned relative to the frame element such that the clamping edge of the clamping tab is not covered by the crossbar, at least when a conductor is inserted and clamped, and can clamp the electrical conductor.

The crossbar can have an additional clamping edge for clamping an electrical conductor, or can form such a clamping edge. Then the crossbar and the clamping tab are aligned with respect to the plane of the busbar and an electrical conductor resting thereon such that the clamping edge of the clamping tab and the clamping edge of the crossbar are located one behind the other in the direction of conductor insertion. In this design, the crossbar can be located ahead of or behind the clamping edge of the clamping tab in the direction of conductor insertion.

The formation of a clamping spring with such a frame element on the clamping leg also has advantages independently of the existence or the embodiment as operating element. In this regard, a spring-loaded terminal for clamping an electrical conductor having an insulating housing, having a busbar, and having a clamping spring that has a contact leg, a spring bend, a clamping leg, and an operating section, offers additional advantages. The clamping leg here has a clamping edge that forms, together with the busbar, a clamping point for clamping the electrical conductor between the clamping edge and the busbar. The operating section of the clamping spring is then formed as a frame element, which has, e.g., two side bars connected to the clamping leg and spaced apart from one another, and optionally has a crossbar connecting the side bars, wherein a clamping tab equipped with the clamping edge projects from the clamping leg between the at least one side bar, or spaced apart therefrom, and the crossbar is located ahead of or behind the clamping edge in the insertion direction.

The crossbar can have an additional clamping edge for clamping an electrical conductor.

In this operating section of the clamping spring implemented as a frame element, the crossbar is optional. The frame element can also be composed only of two side bars connected to the clamping leg and spaced apart from one another. Even though an additional clamping edge is omitted in that case, the advantage remains that the operating section can be stabilized with the aid of the side bars, particularly in the case of loading on one side by the operating element.

Opening of the clamping point is achieved by simple design means through the application of force to the operating section. In this case, the operating lever can be oriented to point toward, e.g., the electrical conductor to be clamped. Handling of the electrical conductor as well as of the operating lever is made easier as a result. However, an embodiment in which the operating arm of the operating lever is oriented to point away from the electrical conductor to be clamped is also possible.

The insulating housing of the spring-loaded terminal can have a recess, wherein the support surface for the operating lever is located in the recess. In this way, the counter bearing for the operating lever provided by the support surface is located at a shorter distance from the operating section of the clamping spring than the bearing section of the operating element. As a result, an even more compact construction of the spring-loaded terminal with good kinematics is made possible.

In order to keep the clamping spring in the open position in which the clamping point is open, the insulating housing can have a surface section that is oriented to hold the operating lever in a position beyond dead center or a rest position.

This surface section can be, for example, a stop surface adjoining the support surface of the insulating housing for the pressure arm section of the operating lever. It is arranged toward the open position in the pivoting direction of the operating lever such that the pressure arm section can be moved past the connecting line between the pivot bearing and the contact of the operating element with the operating section of the clamping spring, and does not contact the stop surface until after this connecting line in the pivoting direction in order to prevent further pivoting and to hold the operating lever in this position beyond dead center.

However, this surface section can also be a step that is located opposite a bearing surface on the operating element for guiding a separate operating tool or opposite a resting surface adjoining the bearing surface. In the open position, the end of the operating tool then rests upon the step, and is held on the step with a force that acts on the operating tool toward the step by means of the operating element.

The above-mentioned object is additionally attained by a spring-loaded terminal for clamping an electrical conductor, wherein the spring-loaded terminal has at least one clamping spring for clamping the electrical conductor onto the spring-loaded terminal and at least one pivotable operating lever for operating the clamping spring, wherein the operating lever can be moved back and forth between an open position, in which a conductor clamping point formed with the clamping spring is open, and a closed position, in which the clamping point is closed, wherein the spring-loaded terminal has an operating element that can be operated by the pivotable operating lever and that is designed as a tension member mounted so as to be essentially linearly movable, through which the clamping point can be opened by means of a tensile force acting on the clamping spring when the operating lever is pivoted into the open position. The advantages explained above can be achieved by this means as well. In contrast to the prior art, the clamping leg of the clamping spring is opened by a tensile force exerted by the tension member, which permits a mechanically favorable force transmission with a compact construction of the spring-loaded terminal. Moreover, the operating lever can be especially ergonomic in design.

The above-mentioned object is additionally attained by a spring-loaded terminal for clamping an electrical conductor, wherein the spring-loaded terminal has at least one clamping spring for clamping the electrical conductor onto the spring-loaded terminal and at least one pivotable operating lever for operating the clamping spring, wherein the operating lever can be moved back and forth between an open position, in which a conductor clamping point formed with the clamping spring is open, and a closed position, in which the clamping point is closed, wherein the open position and the closed position constitute end positions of the pivoting motion of the operating lever at which the operating lever comes to rest against a mechanical stop, wherein the operating lever can be pivoted beyond at least one of the end positions into an overpressure position without parts of the spring-loaded terminal being damaged or the operating lever detaching from the spring-loaded terminal in the process. In this way, the spring-loaded terminal, and in particular the bearing of the operating lever, can be protected from damage, even under the action of excessive force. The operating lever can thus avoid the action of excessive force to a certain extent, since it has a certain idle movement or idle travel.

The operating element can be linearly movable by the motion of the operating lever into the at least one overpressure position. During this overpressure motion of the operating lever, the operating element can thus continue its linear motion, at least partially. If the operating lever has arrived at the overpressure position, the operating element can also once again be located in the same linear position as previously, at the end position near the overpressure position, which is to say the open position.

The operating lever can be rotatably mounted on the linearly movable operating element, wherein the operating lever participates in the linear motion of the operating element when the operating lever is moved into the at least one overpressure position. In this way, the operating lever can avoid the excessive operating force that is being applied without damage occurring to the operating lever or its bearing.

The spring-loaded terminal can have an overpressure contour formed on the insulating housing or another part of the spring-loaded terminal, along which the support contour slides when the operating lever is moved into the overpressure position. In this way, the operating lever can be reliably guided into the overpressure position.

According to an advantageous improvement of the invention, provision is made that at least sections of the overpressure contour run at an angle to the direction of linear motion of the operating element. In this way, the overpressure contour can form a kind of temporary stop at the end position of the operating lever, and at the same time accomplish appropriate guidance of the operating lever into the overpressure position.

The operating force of the operating lever can rise when the operating lever is moved from the end position into the overpressure position. This has the advantage that the user haptically obtains the information that the end position per se has been reached.

The operating lever, as already mentioned, is pivotably mounted on the spring-loaded terminal by a pivot bearing. The operating lever in this design can be attached to any retaining part of the spring-loaded terminal, which is to say this retaining part then contains bearing elements on the retaining part side to form a part of the pivot bearing. This retaining part of the spring-loaded terminal can be a region of the insulating housing or the operating element, for example. The operating lever in this design has lever-side bearing elements of the pivot bearing. In this design, the bearing elements on one side, which is to say either the bearing elements on the lever side or the bearing elements on the retaining part side, can be designed as a journal and the mating part of the bearing element can be designed as a bearing bore, for example as a through hole or as a blind hole.

The operating lever can be attached to a retaining part of the spring-loaded terminal, in particular is attached to the operating element, namely in such a way that the operating lever cannot be nondestructively detached from the retaining part. The spring-loaded terminal thus has an indivisible, prefabricated subassembly that has at least the operating lever and the retaining part. In this way, assembly time can be saved when assembling the individual parts of the spring-loaded terminal.

The operating lever can be attached to a retaining part of the spring-loaded terminal by a pivot bearing, wherein the operating lever has bearing elements of the pivot bearing on the lever side, and the retaining part has bearing elements of the pivot bearing on the retaining part side, wherein the retaining-part-side bearing elements are molded directly in a positive-locking manner around the lever-side bearing elements or onto the lever-side bearing elements during manufacture. This can be accomplished, for example, by the means that the lever-side bearing elements are molded-in by the retaining-part-side bearing elements in a plastics injection molding process.

The material of the lever-side bearing elements can have a different melting temperature than the material of the retaining-part-side bearing elements. Thus, the melting temperature of the lever-side bearing elements, in particular, can be higher than the melting temperature of the material of the retaining-part-side bearing elements. In this way, damage to the lever-side bearing elements is avoided during the process of molding the retaining-part-side bearing elements onto the lever-side bearing elements.

The above-mentioned advantages can be achieved, moreover, by a method for producing a spring-loaded terminal for clamping an electrical conductor, wherein the spring-loaded terminal has at least one clamping spring for clamping the electrical conductor onto the spring-loaded terminal and at least one pivotable operating lever for operating the clamping spring that is attached to a retaining part of the spring-loaded terminal by a pivot bearing, having the steps: producing the operating lever with lever-side elements of the pivot bearing; producing the retaining part of the spring-loaded terminal on which the operating lever is mounted, by the means that the retaining part with retaining-part-side bearing elements of the pivot bearing is formed around the lever-side bearing elements of the pivot bearing so that the lever-side bearing elements of the pivot bearing are supported by the retaining-part-side bearing elements of the pivot bearing during the process of producing the retaining part; and/or completing the spring-loaded terminal with the subassembly formed of the operating lever and the retaining part of the spring-loaded terminal to which the operating lever is attached, and also the remaining elements of the spring-loaded terminal, including the clamping spring.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
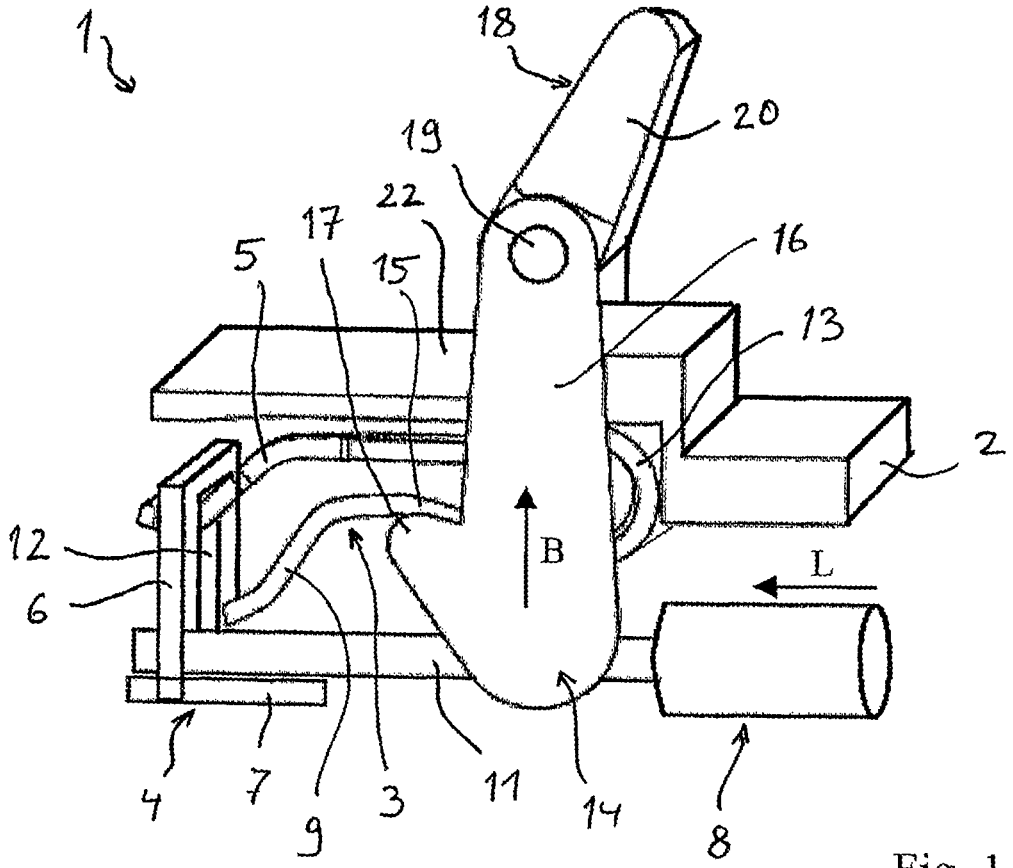
FIG. 1*a*) is a drawing of an embodiment of a spring-loaded terminal in an open position with electrical conductor inserted and pivotable pull-type operating lever.
FIG. 1*b*) is a drawing of the spring-loaded terminal from FIG. 1*a*) in a closed position.
Figure 1:
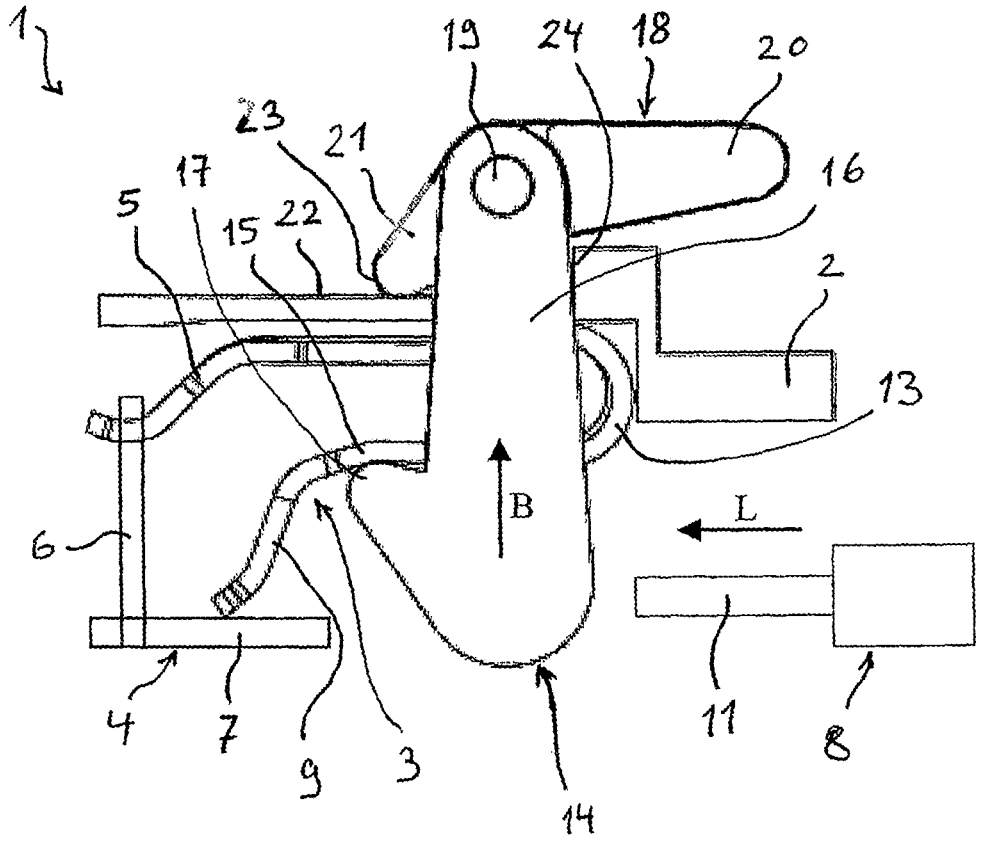

FIG. 1*a*) shows a drawing of a spring-loaded terminal 1, which has an insulating housing 2, a clamping spring 3 supported in the insulating housing 2, and a busbar 4. The clamping spring 3 is supported on the busbar 4 with a contact leg 5. For this purpose, a retaining frame 6, for example, can extend away from a support section 7 of the busbar 4. As a result, the clamping spring 3 is arranged to be self-supporting on the busbar 4 without exerting significant force on the insulating housing 2.

An electrical conductor 8 is inserted into the insulating housing 2 in a conductor entry passage in the insulating housing 2 in the direction of conductor insertion L. In the open position shown, it can then be passed between a clamping leg 9 of the clamping spring 3 and the support section 7 of the busbar 4 (contact section) so that a clamping edge 10 on the free end of the clamping leg 9, together with the busbar 4, forms a clamping point for clamping the electrical conductor 8. It is made evident that the stripped end 11 of the electrical conductor 8 is positioned between the support section 7 and the clamping edge 10, and is passed through a conductor feedthrough opening 12 in a bearing section designed as retaining frame 6. On the support section 7 of the busbar 4, a projecting contact edge can be present on which the contact force of the clamping spring 3 is concentrated when an electrical conductor 8 is clamped.

The clamping spring 3 is designed as a U-shaped leg spring with the contact leg 5 adjoined by a spring bend 13, which is adjoined by the clamping leg 9.

Now, in order to open the clamping point to remove the electrical conductor 8, an operating element 14 is present, which is built into the insulating housing 2 so as to be linearly movable. The operating element 14 engages beneath an operating section 15 located on the clamping leg 9 in order to move the clamping leg 9 toward the contact leg 5 by linear displacement of the operating element 14. The operating element 14 acts on the operating section 15 of the clamping spring 3, and thus on the side of the operating section 15 facing away from the contact leg. In this way, a compressive force is exerted on the operating section 15 to open the clamping point.

It is made evident that the operating element 14 has a guide wall 16 guided laterally past the clamping spring 3, with a finger 17 that is arranged on the guide wall 16 and that rests on the operating section 15 in the open position shown.

For the purpose of moving the operating element 14, an operating lever 18 is pivotably arranged on the operating element 14. To this end, a pivot bearing 19 is present on the operating lever 18 and operating element 14. The pivot bearing 19 can be implemented as, for example, a journal bearing in which a journal projects into a bearing opening. The journal can be present on the operating lever 18 or the operating element 14, and the corresponding bearing opening can then be present on another element, i.e., the operating element 14 or the operating lever 18.

FIG. 1*b*) shows the spring-loaded terminal 1 from FIG. 1*a*) in the closed position. It is made evident that the operating lever 18 is now pivoted down, with its lever arm section 20 downward toward the conductor entry opening or toward the clamping spring 3. It can additionally be seen that the operating lever 18 has a pressure arm section 21 opposite the lever arm section 20. This pressure arm section 21 interacts with a support surface 22 of the insulating housing 2, and, at least when pivoted into the open position, rests on this support surface 22 of the insulating housing 2. During pivoting, the rounded support contour 23 of the pressure arm section 21 then slides along the surface of the support surface 22, forming a plain bearing. The counter bearing is formed by the pivot bearing 19, by means of which the operating element 14 is then displaced linearly in the operating direction B.

When the operating lever 18 is now pivoted counterclockwise into the open position as in FIG. 1, the finger 17 of the operating element 14 then travels upward in the operating direction B in order to move the clamping leg 9 toward the contact leg 5 against the spring force of the clamping spring 3. In this process, the operating element 14 is guided in a linearly movable manner on the insulating housing 2.

In this embodiment of the spring-loaded terminal 1, the presence of just one operating element 14 on one side of the clamping spring 3 is not the only possibility. An embodiment is also possible in which two operating elements 14 are located opposite one another, next to the clamping spring 3 on both sides, forming a free space to accommodate the clamping spring 3. The narrow edges of the contact leg 5 and of the clamping leg 9 are then each adjacent to an operating element 14.

It is also possible, however, that the operating element 14 is not located laterally next to the clamping spring 3. It can also be arranged adjacent to the clamping spring 3 in different ways, as for example ahead of or behind the clamping spring 3 in the direction of conductor insertion L.

In any case, it is then designed such that the clamping leg 9 is movable by linear displacement of the operating element 14. The linear displacement of the operating element 14 is accomplished by means of the operating lever 18 that is pivotably connected to the operating element 14.

It can further be seen in this exemplary embodiment that the support surface 22 transitions into a surface section in the form of a stop surface 24 that projects from the support surface 22. This stop surface 24 is arranged toward the open position in the pivoting direction of the operating lever 18 such that the pressure arm section 21 can be moved at least past the connecting line between the pivot bearing 19 and the contact of the operating element 14 with the operating section 15 of the clamping spring 3, and does not contact the stop surface 24 until after this connecting line in the pivoting direction in order to prevent further pivoting and to hold the operating lever 18 in this position beyond dead center. In the exemplary embodiment shown, a position beyond dead center is guaranteed in any case when the pressure arm section 21 has crossed the connecting line that passes through the pivot bearing 19 and is oriented in the operating direction B, and the stop surface 24 is located behind this connecting line in the pivoting direction toward the open position. This connecting line is parallel to the direction of linear motion of the operating element 14 and thus is parallel to guide bearings for the operating element 14. With the stop surface 24, a further pivoting of the operating lever 18 is prevented and the operating lever 18 is held in a position beyond dead center with the clamping point open, wherein a force of the clamping spring 3 acts on the operating element 14.

In the first embodiment shown, the pressure arm section 21 and the lever arm section 20 project from the common pivot bearing 19 in opposite directions from one another. The pressure arm section 21 and the lever arm section 20 are oriented with their primary directions of extent (e.g., central axes) at an obtuse angle (greater than 90°) to one another. The interior angle between the pressure arm section 21 and the lever arm section 20 can be limited to a range of 180° to 120°, for example.

Figure 2:
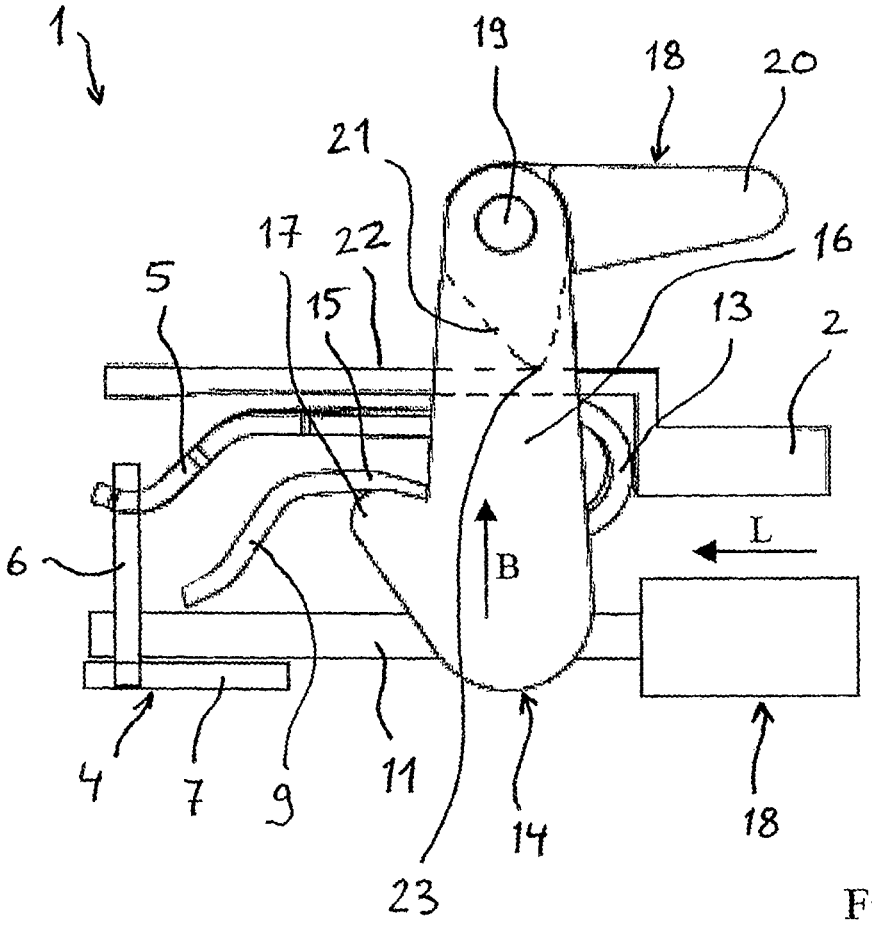
FIG. 2*a*) is a drawing of an embodiment of a spring-loaded terminal in an open position with electrical conductor inserted and pivotable push-type operating lever.
FIG. 2*b*) is a drawing of the spring-loaded terminal from FIG. 2*a*) in the closed position.
Figure 2:
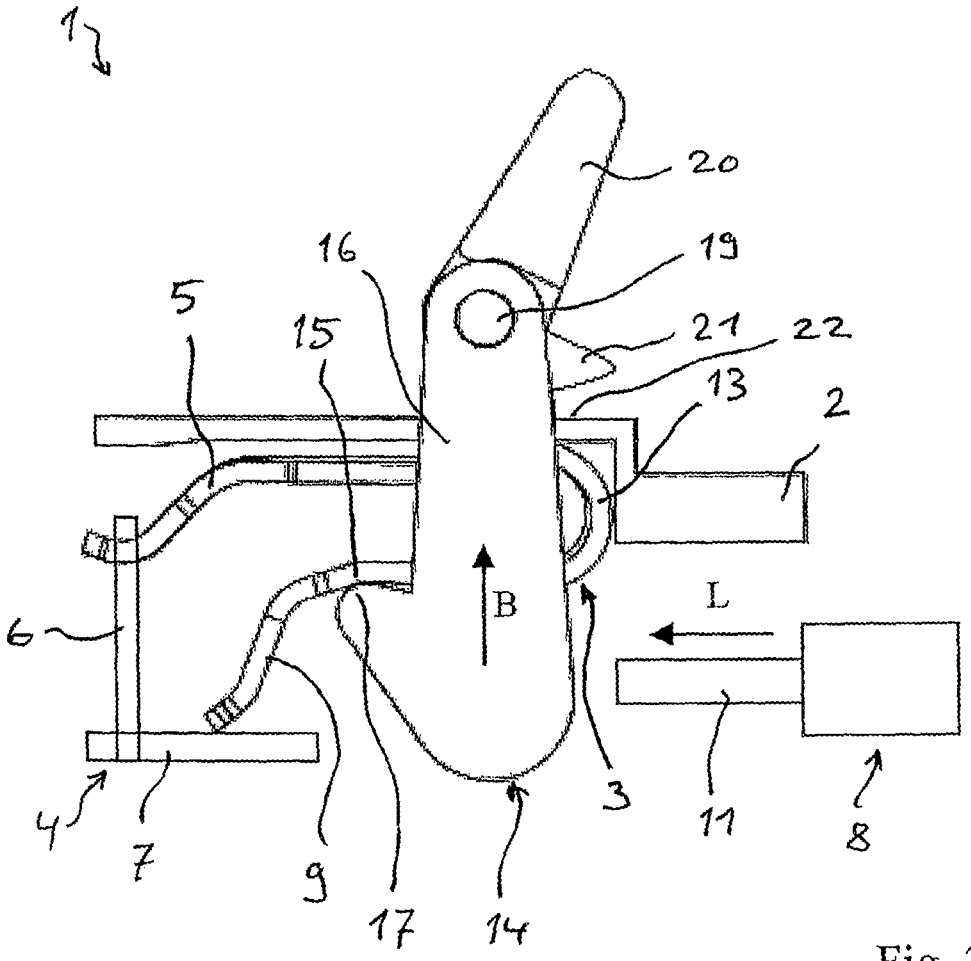

FIG. 2*a*) shows a drawing of a second embodiment of the spring-loaded terminal 1. The above remarks can essentially be referenced here. The difference from the first embodiment resides in the implementation of the operating lever 18. The pressure arm section 21 is located on the same side of the pivot bearing 19 as the lever arm section 20. The pressure arm section 21 and the lever arm section 20 are oriented with their primary directions of extent (e.g., central axes) at an acute angle (less than 90°) to one another. The interior angle between the pressure arm section 21 and the lever arm section 20 can be limited to a range of 10° to 90°, for example.

In the open position shown in FIG. 2*a*), the pressure arm section 21 is then oriented toward the support surface 22 from the pivot bearing 19, and rests on the support surface 22. The pressure arm section 21 is then positioned to the side next to the operating element 14. This corresponds to the orientation in the first exemplary embodiment, and leads to opening of the clamping spring 3.

FIG. 2*b*) shows a drawing of the second embodiment of the spring-loaded terminal 1 in the closed position. Pivoting the operating lever 18 causes the pressure arm section 21 to be oriented opposite the direction of conductor insertion L, pointing toward the electrical conductor 8 to be inserted. The lever arm section 20 projects upward, away from the insulating housing 2, as is the case in the first exemplary embodiment in the open position (FIG. 1*a*).

A stop surface 24 can optionally be provided as in the first exemplary embodiment, which then projects from the support surface 22, only spatially offset on the opposite side of the pivot bearing 19, approximately in space above the finger 17.

Operation of the clamping spring 3 by pivoting of the operating lever 18 is accomplished in the first exemplary embodiment by exerting a tensile force on the lever arm section 20, and in the second exemplary embodiment by exerting a compressive force on the lever arm section 20.

Figure 3:
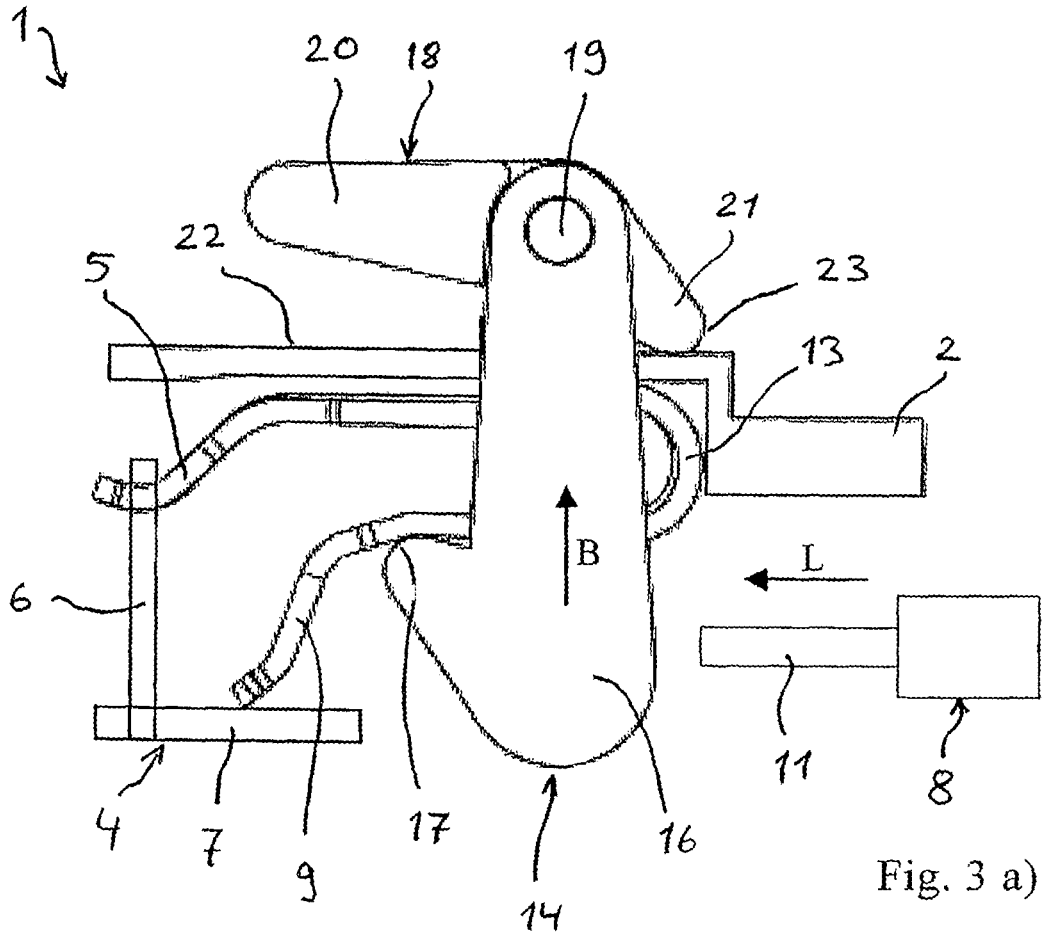
FIG. 3*a*) is a drawing of a modification of the embodiment of a spring-loaded terminal in the open position with pull-type operating lever pointing in the direction of conductor insertion.
FIG. 3*b*) is a drawing of a modification of the embodiment of a spring-loaded terminal in the open position with push-type operating lever pointing in the direction of conductor insertion.
Figure 3:
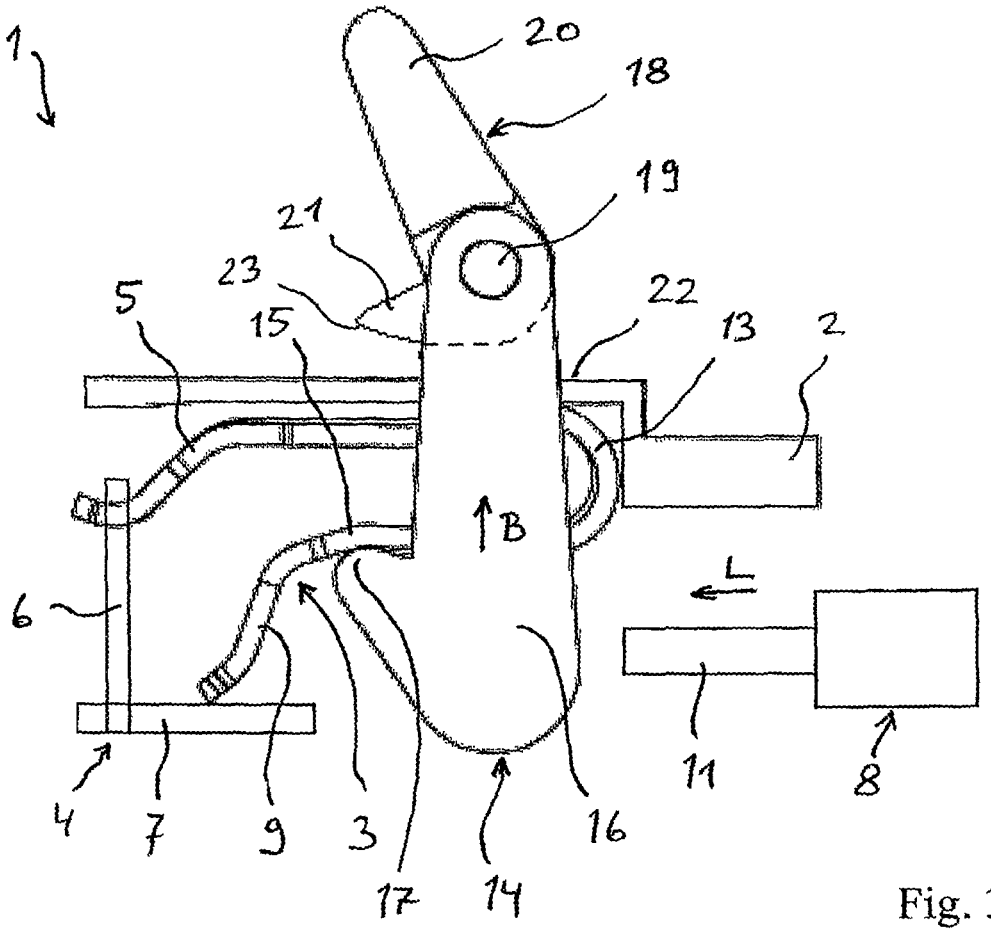

FIG. 3*a*) shows a modification of the first exemplary embodiment of the spring-loaded terminal 1 shown in FIGS. 1*a*) and 1*b*). It is made evident that the operating lever 18 is mirror-imaged in its arrangement so that the lever arm section is oriented to point in the direction of conductor insertion L in the closed position. Here, too, operation is accomplished by exerting a tensile force on the operating lever 18. As in the first exemplary embodiment, a stop surface 24 can optionally be provided, which then correspondingly projects from the support surface 22 on the opposite side, approximately in space above the finger 17.

FIG. 3*b*) shows a modification of the second exemplary embodiment of the spring-loaded terminal 1 shown in FIGS. 2*a*) and 2*b*). It is made evident that the operating lever 18 is mirror-imaged in its arrangement so that the lever arm section is oriented to point in the direction of conductor insertion L in the open position. Here, too, operation is accomplished by exerting a tensile force on the operating lever 18. A stop surface 24 can optionally be provided, as in the first exemplary embodiment.

Figure 4:
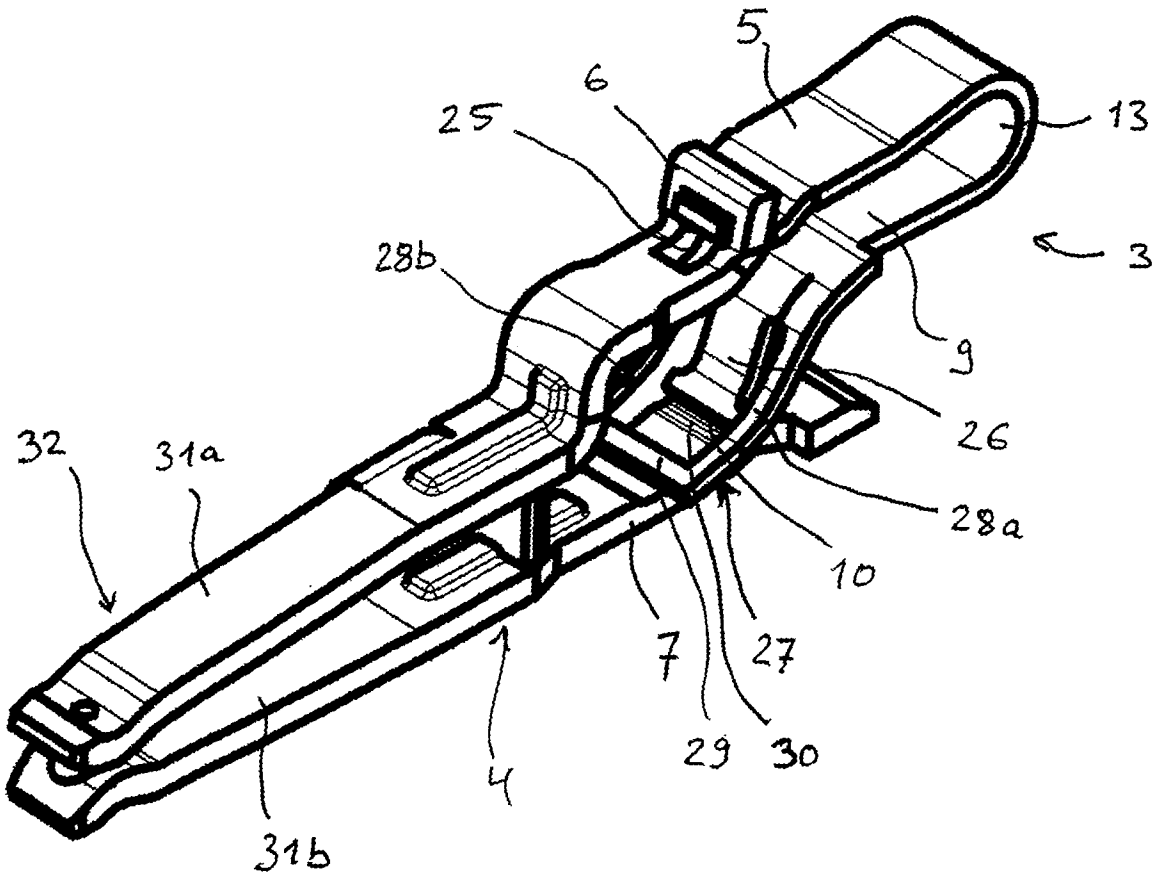
FIG. 4 is a perspective detail view of a clamping spring mounted on a busbar with a frame element.

FIG. 4 shows a perspective view of a clamping spring 3, suitable for the above-described spring-loaded terminal 1, which is suspended by its contact leg 5 in the busbar 4. For this purpose, a retaining frame 6 with a retaining opening 25 projects from the support section 7 of the busbar 4. The free end of the contact leg 5 projects into this retaining opening 25 in order to thus fix the clamping spring 3 in its position on the busbar 4.

Adjoining the contact leg 5 is a spring bend 13, which transitions into the clamping leg 9. The clamping leg 9 has a clamping tab 26, which has the clamping edge 10 at its free end. In addition, a frame element 27 is connected to the clamping leg 9. This frame element 27 has two side bars 28*a*, 28*b* projecting from the clamping leg 9 and integrally implemented therewith, which optionally can be connected to one another at their ends by a crossbar 29. The frame element 27 provides an operating section on which an operating element 14 can exert an operating force. The crossbar 29 can be omitted if the side bars 28*a*, 28*b* are suitably dimensioned. It is made evident that the crossbar 29 is behind the clamping edge 10 in the direction of conductor insertion L. In the rest position shown, the crossbar 29 in this design can rest on the busbar 4 in the same way as the clamping edge 10 of the clamping tab 26.

It is additionally evident that a contact edge 30 is formed on the busbar 4. The clamping edge 10 of the clamping tab 26 is oriented such that it, together with this contact edge 30, forms a clamping point for clamping an electrical conductor 8 so that the clamping force of the clamping spring 3 is concentrated at the contact edge 30.

In the exemplary embodiment shown, a contact jack 32 is formed on the busbar 4 by two prongs 31*a*, 31*b*.

Figure 5:
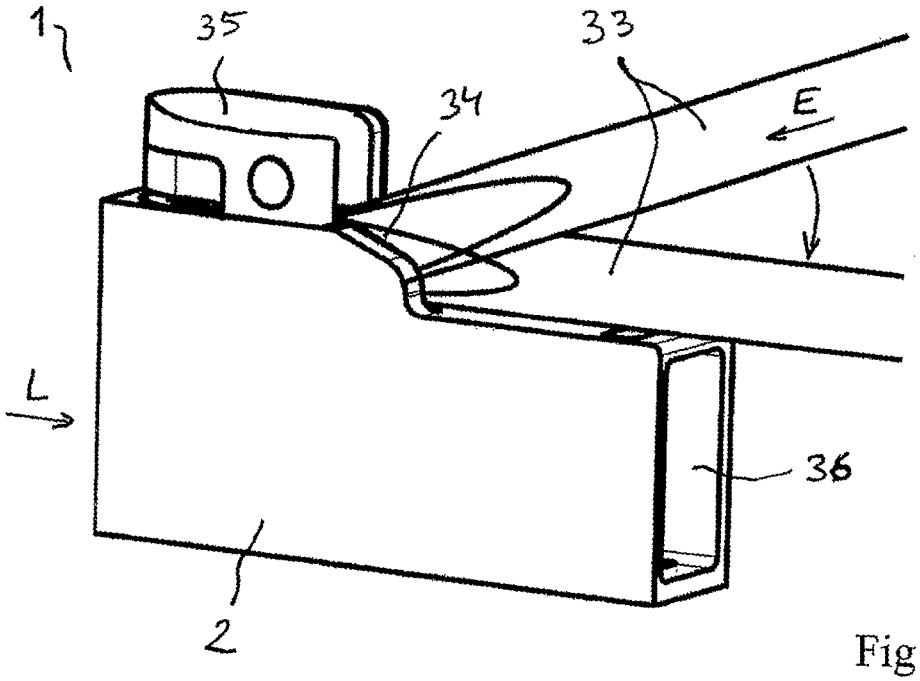
FIG. 5*a*) is a perspective view of an embodiment of a spring-loaded terminal with separate operating tool as operating lever and showing a plug contact opening.
FIG. 5*b*) is a perspective view of the spring-loaded terminal from FIG. 5*a*), showing the conductor entry passage.
Figure 5:
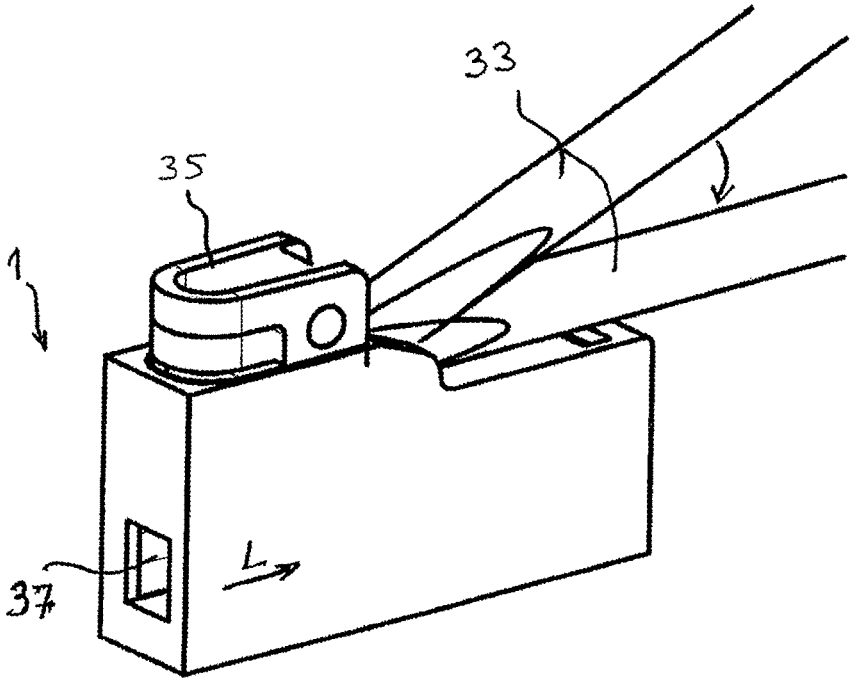

FIG. 5*a*) shows a third embodiment of a spring-loaded terminal 1 with an insulating housing 2.

In this exemplary embodiment, a separate operating tool, as for example a screwdriver, which can be inserted into a free space 34 in the insertion direction E, is provided as operating lever 33. Pivoting the operating lever 33 implemented as an operating tool, as is indicated by the operating lever 33 drawn in two positions and also by the arrow, causes the operating element 35 in the insulating housing 2 to move linearly in order to thus open the clamping point.

Visible in the insulating housing 2 is the conductor entry passage 36, through which an electrical conductor 8 can be inserted into the interior of the insulating housing 2 in the direction of conductor insertion L. This passage is still relatively large, but can be given a reduced cross-section by snapping in a cover part with a conductor guide opening introduced therein.

FIG. 5*b*) shows a perspective rear view of the spring-loaded terminal 1 from FIG. 5*a*). A rear contact opening 37—for receiving a connector—that leads to the contact jack 32 is now visible.

Figure 6:
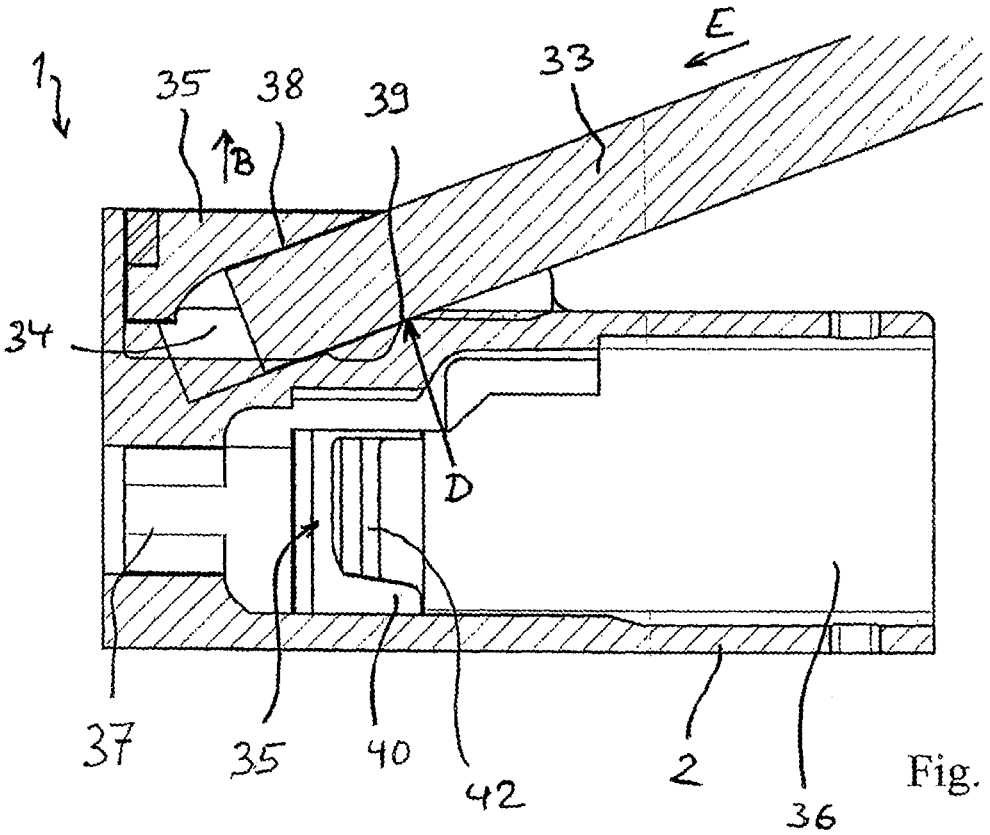
FIG. 6*a*) is a sectional side view of the spring-loaded terminal from FIGS. 5*a*) and 5*b*) with an operating tool inserted.
FIG. 6*b*) is a perspective sectional view of the spring-loaded terminal from FIGS. 5*a*) and 5*b*) with operating tool inserted.
Figure 6:
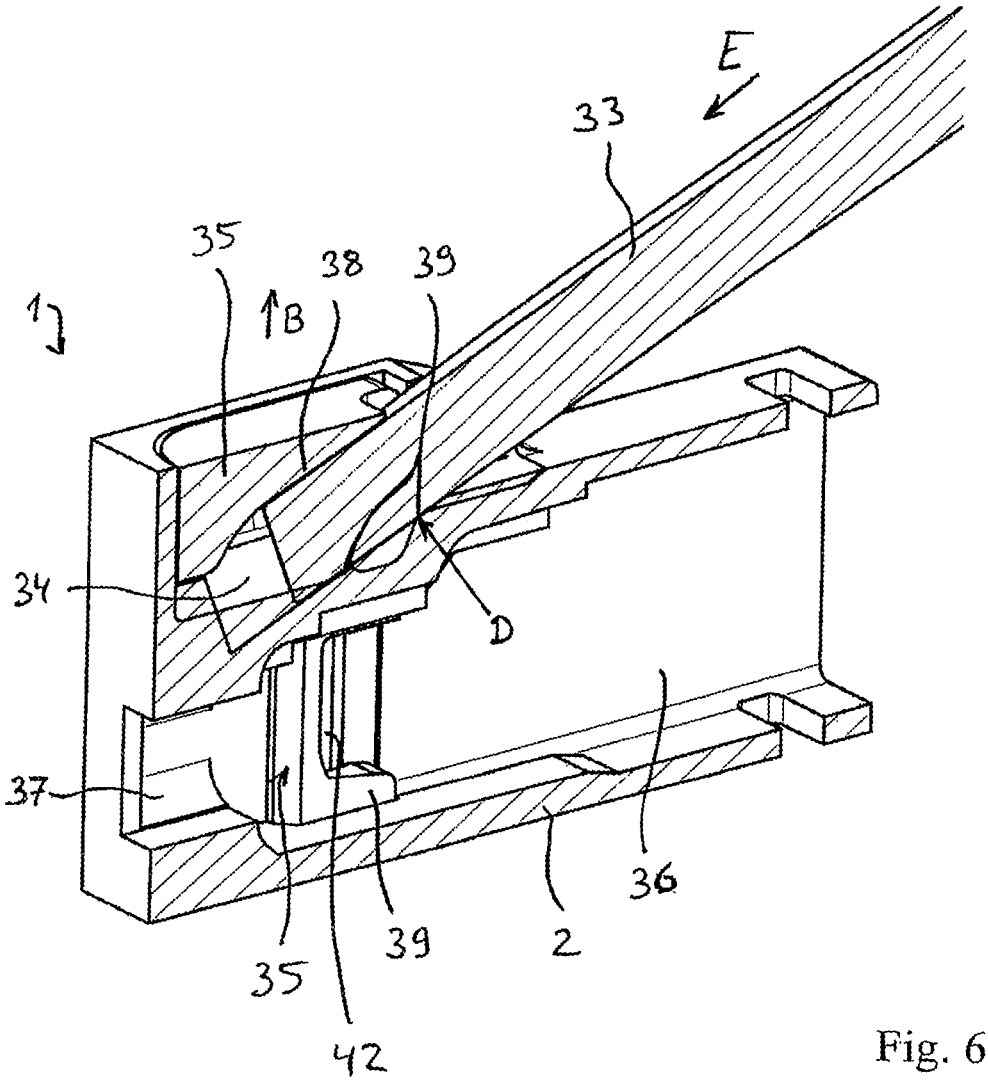

The construction of the spring-loaded terminal 1 is more clearly evident from the cross-sectional representations, FIG. 6*a*) being in a side view and FIG. 6*b*) being in a perspective view. It can be seen that the operating element 35 has a bearing surface 38, which is located in the free space 34 opposite a support surface 39 of the insulating housing 2. The support surface 39 forms a fulcrum D, which is indicated by the arrow, for the operating tool (which is to say the operating lever 33) that is supported there on the insulating housing 2. The opposing bearing surface 38 of the operating element 35 forms a counter bearing, along which the operating tool slides when pivoted toward the insulating housing 2. In this process, the operating element 35 is moved linearly upward in the operating direction B in order to thus move the clamping leg 9 of the clamping spring 3 and open the clamping point for clamping an electrical conductor 8 or for removing a clamped electrical conductor 8.

It can be seen that the operating element 35 projects into the interior of the insulating housing 2, and has a finger 40 at its end. This finger engages beneath an operating section of a clamping spring.

This operating section can be a tab projecting laterally from the clamping leg 9, for example.

It is also made evident that the bearing surface 38 of the operating element 35 has a curved path shape pointing toward the opposite support surface 39. It is also made evident that the effectively active bearing surface 38 is arranged to be offset from the support surface 39 of the insulating housing 2 in the direction of extent of the operating tool (which is to say the operating lever 33) or in its insertion direction E.

Figure 7:
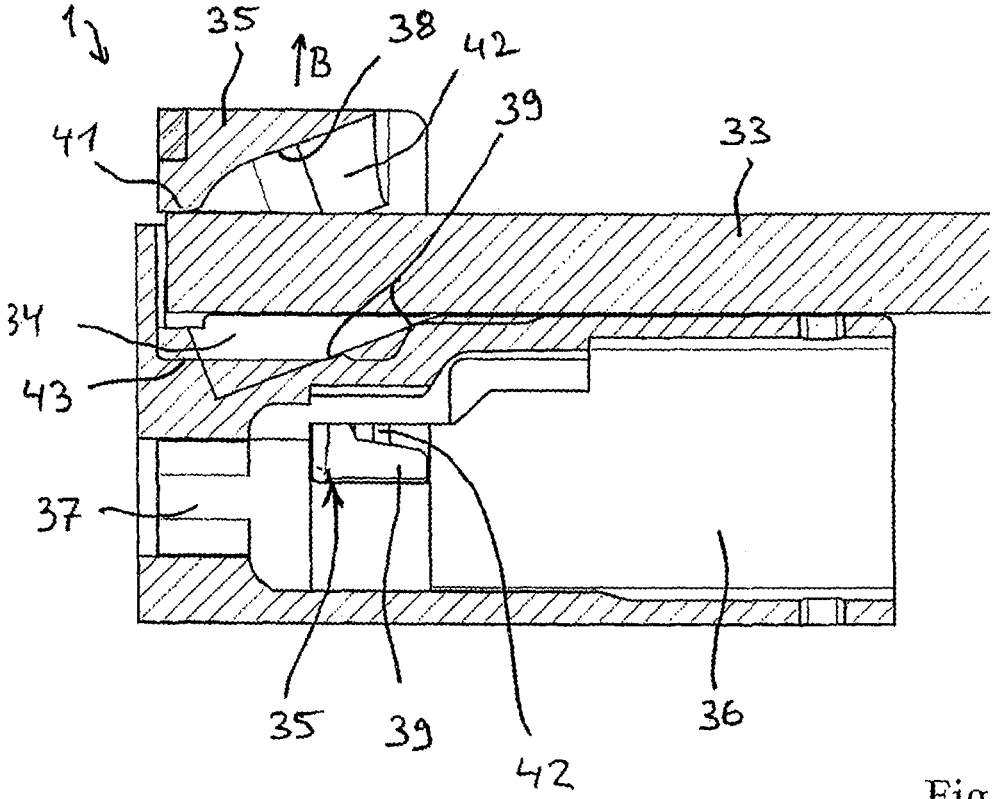
FIG. 7*a*) is a sectional side view of the spring-loaded terminal from FIGS. 5*a*) and 5*b*) with operating tool, in the open position.
FIG. 7*b*) is a perspective sectional view of the spring-loaded terminal from FIGS. 5*a*) and 5*b*) with operating tool, in the open position.
Figure 7:
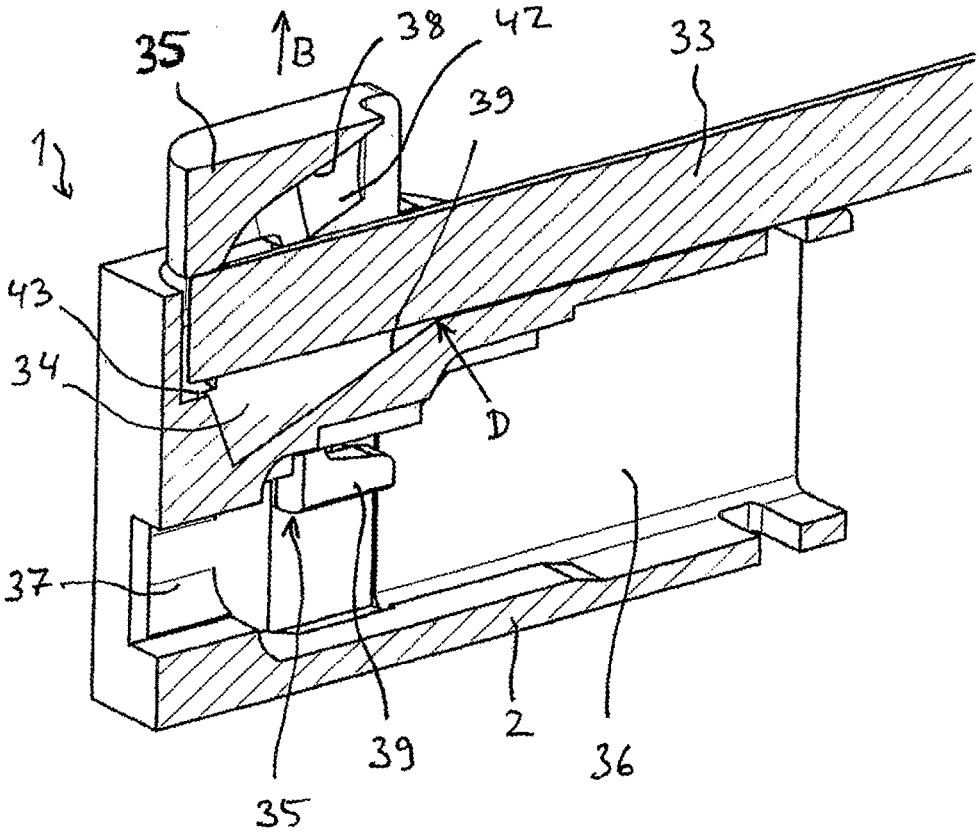

FIG. 7*a*) shows the spring-loaded terminal 1 from FIGS. 5*a*), 5*b*), 6*a*), and 6*b*) in the open position in sectional side view, and FIG. 7*b*) shows it in a perspective sectional view. It is made evident that the operating tool (operating lever 33) has now been pivoted downward toward the insulating housing 2. In this process, the operating element 35 is now moved linearly out of the insulating housing 2 far enough that the operating tool rests on a resting surface 41 that follows the bearing surface 38.

It is also made evident that the operating tool (operating lever 33) is inserted into the free space 34 delimited by the support surface 39 and the bearing surface 38. The free space 34 becomes larger in the height direction (which is to say in the operating direction B), the further the operating lever 33 is inserted between the operating element 35 and the insulating housing 2. It is further made evident that the operating element 35 has two guide walls 42 that are spaced apart to accommodate the operating lever 33 between them, and are mounted in the insulating housing 2 so as to be linearly movable. At least one of the guide walls 42 has, at its free end, a finger 39 that engages beneath the operating section 15 of the clamping leg 9. This operating section 15 can also be provided by the side bars 28*a*, 28*b* of the exemplary embodiment from FIG. 4 or by the clamping tab 26.

It is made evident that the free space 34 is implemented as a passage pointing at an angle into the insulating housing 2 and matched to the width of an operating lever 33 implemented as operating tool. This passage now expands when the operating element 35 is moved linearly. The free space 34 has at its bottom a step 43 that is opposite the resting surface 41. In the open position shown in FIGS. 7*a*) and 7*b*), the operating tool can then be inserted as shown into the free space 34 far enough that the free end of the operating tool rests on the step 43, and on the opposite side the resting surface 41 acts on the operating tool. In this process, the clamping spring 3 exerts a spring force on the operating element 35 through the support on the finger 40 of the operating section 15 of the clamping spring 3, with which force the operating tool (which is to say the operating lever 33) is clamped in the position shown.

A modification of the third embodiment shown in FIGS. 5*a*) to 7*b*) is also possible to the effect that the operating lever 33 shown is not a separate part, but instead is implemented as a lever arm pivotably mounted on the insulating housing.

In the embodiments described above, the lever arm section 20 or the operating lever 33 implemented as operating tool can point toward the conductor 8 that is to be clamped, or away from it. Both variants can be realized equally well, since the linear guidance of the operating element 14, 35 is independent therefrom.

Figure 8:
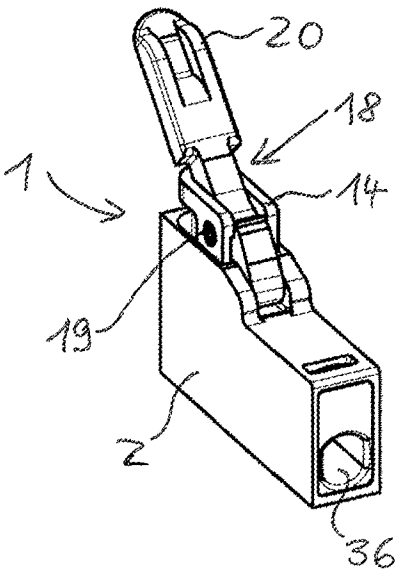
FIG. 8 is perspective views of an embodiment of a spring-loaded terminal in different positions of the operating lever.
Figure 8:
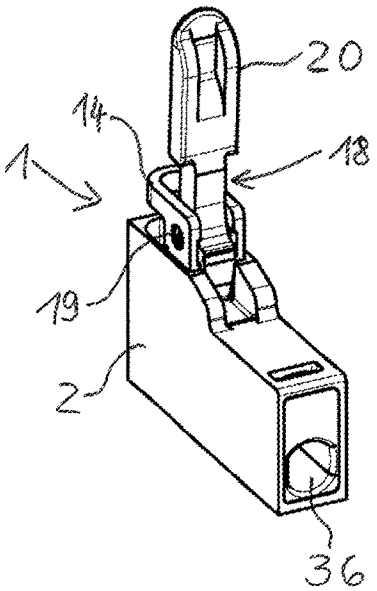
Figure 8:
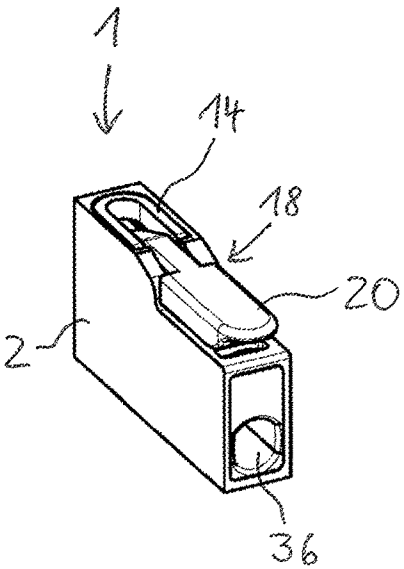

The spring-loaded terminal 1 shown in FIG. 8 has an insulating housing 2 in which the other elements, including the busbar 4 and the clamping spring 3, are located, and thus are not visible in the illustrations in FIG. 8. The spring-loaded terminal 1 has an operating lever 18 that is mounted on an operating element 14 by means of a pivot bearing 19. The operating element 14 can, in particular, be shaped similarly to the operating element 35 described on the basis of FIGS. 5*a*), 5*b*). The operating lever 18 again has the lever arm section 20 through which it can be manually operated. The insulating housing 2 has a conductor entry passage 36 into which an electrical conductor can be inserted.

FIG. 8 shows the spring-loaded terminal with the operating lever 18 in the closed position (illustration a), which constitutes one end position of the pivoting motion of the operating lever 18. In illustration b, the operating lever is pivoted into the open position, which constitutes the other end position of the pivoting motion of the operating lever 18. Illustration c shows that the operating lever 18 is pivoted into an overpressure position by continuing to pivot the operating lever past the end position that corresponds to the open position.

Figure 9:
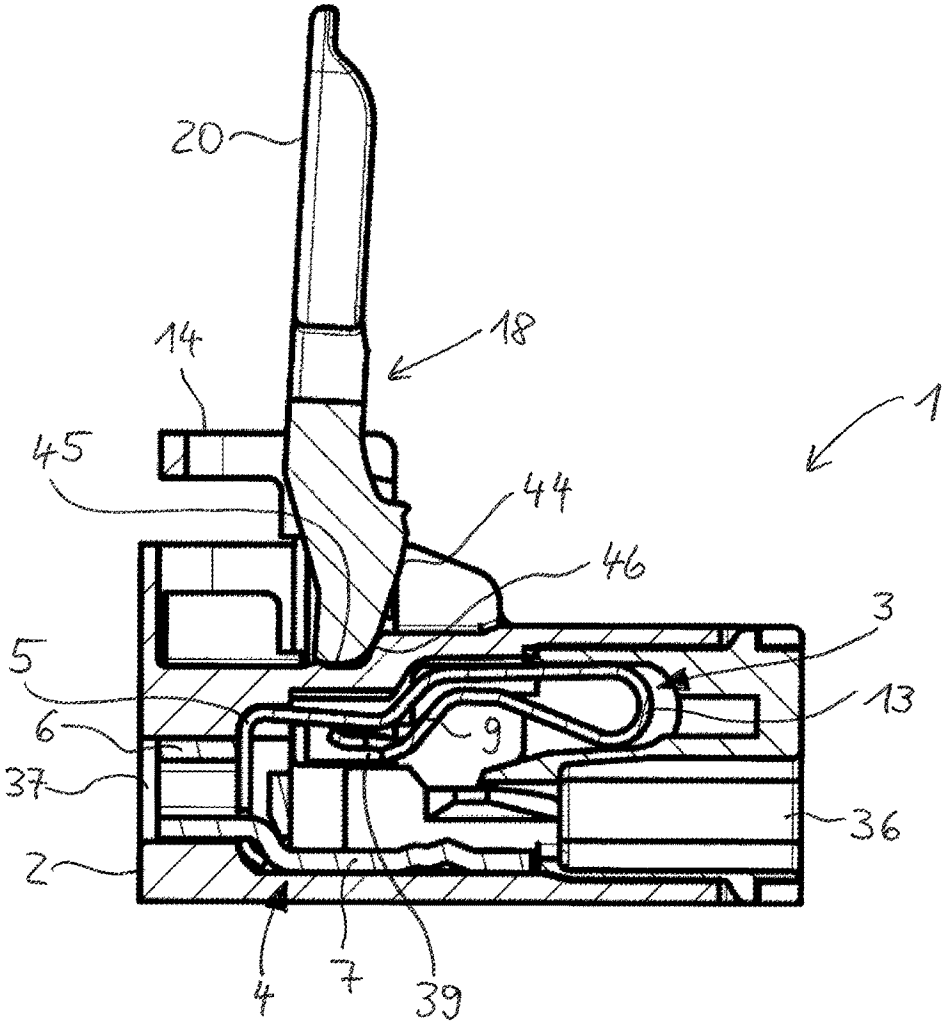
FIGS. 9, 10 show the spring-loaded terminal from FIG. 8 in sectional side views.

FIG. 9 shows the spring-loaded terminal from FIG. 8 in a sectional side view, with the operating lever 18 being in the open position. Visible, in particular, is the clamping spring 3—located in the insulating housing 2—with the clamping leg 9, the spring bend 13, and the contact leg 5. The contact leg 5 is attached to a retaining frame 6 of the busbar 4. Since the operating lever 18 is in the open position, the clamping leg 9 is deflected upward by means of the support surface 39 of the operating element 14 so that the clamping edge of the clamping leg 9 is not resting on the support section 7 of the busbar 4.

The operating lever 18 has a support surface that extends over a first section 44 to a second section 45 that runs at an angle thereto. When the operating lever 18 is in the closed position, the first section 44 of the support surface rests on the insulating housing 2. As can be seen, the lever 18 in the open position is supported on the insulating housing 2 by the second section 45 of the support surface, and in this position is loaded against the insulating housing 2 by the force of the clamping spring 3.

It can also be seen in FIG. 9 that an overpressure contour 46 extending at an angle on the insulating housing 2 adjoins the region in which the operating lever 18 rests on the insulating housing 2 in the open position. When the operating lever 18 is in the open position (FIG. 9), the overpressure contour 46 forms a mechanical stop through which a user perceives that the operating lever is located at its end position per se. In the embodiment of the spring-loaded terminal shown here, overpressure is possible, however.

Figure 10:
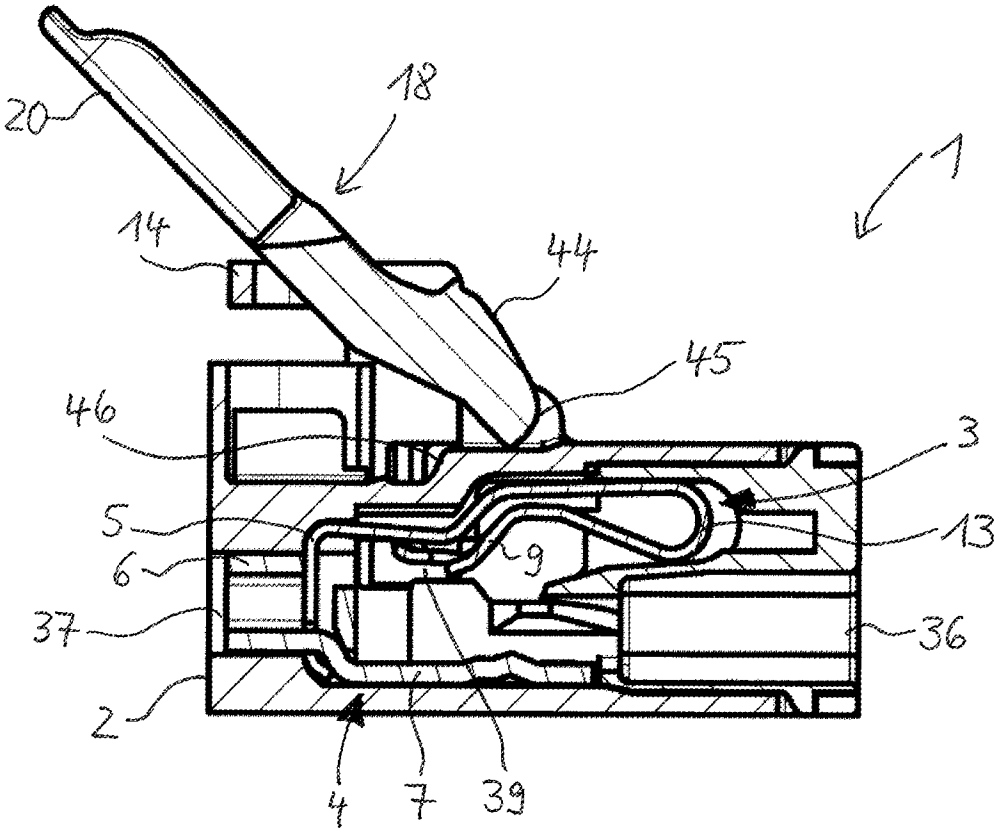

FIG. 10 shows the spring-loaded terminal with the operating lever 18 in the overpressure position. As can be seen, the second section 45 of the support surface of the operating lever 18 has also gone past the overpressure section 46 and rests on a point on the insulating housing 2 that is behind this section. From this overpressure position, the operating lever 18 can readily be moved back into the open position or the closed position, without damage or detachment of the operating lever 18 occurring.

Figure 11:
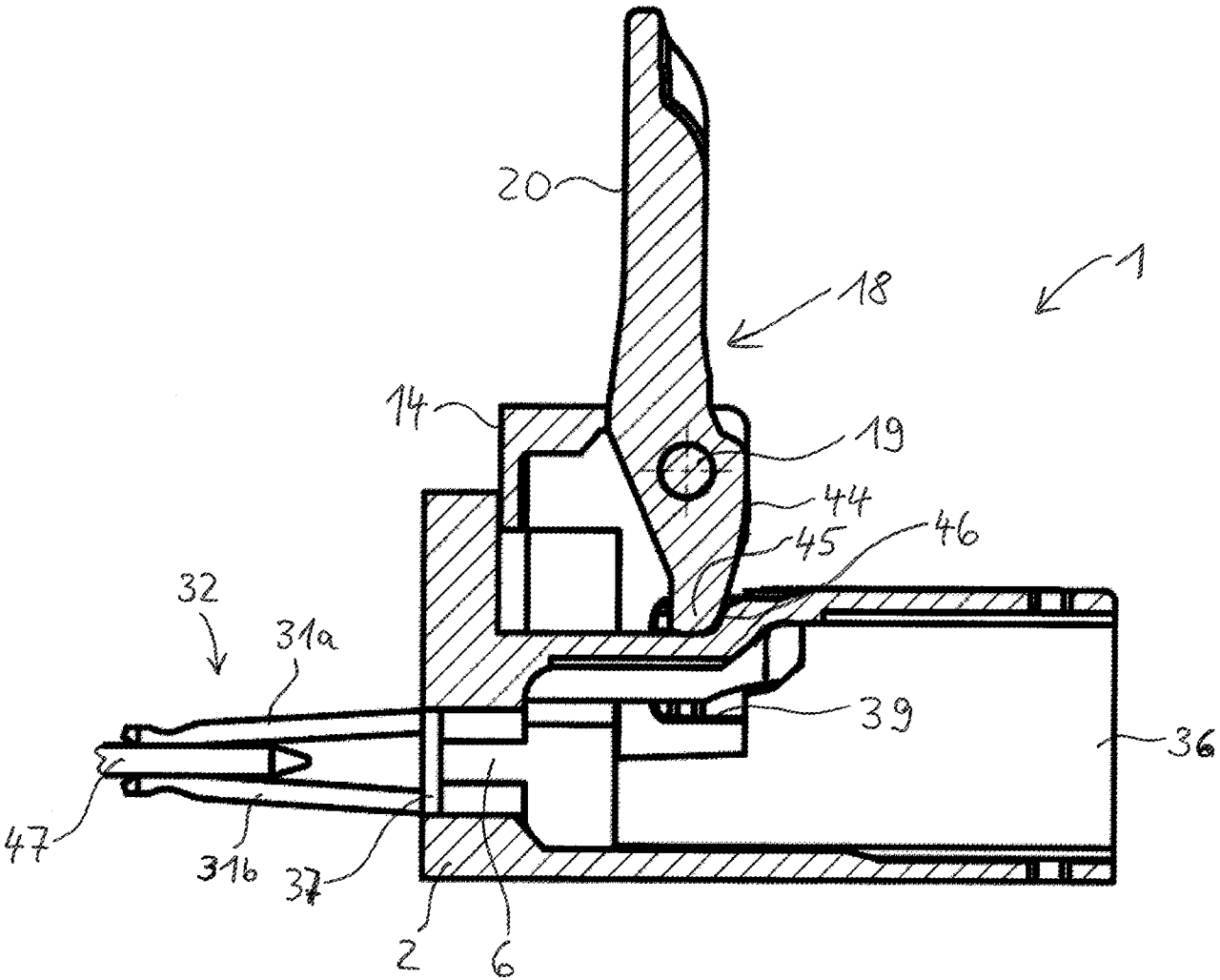
FIG. 11 is an embodiment of a spring-loaded terminal in a sectional side view.

FIG. 11 shows another embodiment of the spring-loaded terminal that corresponds to the embodiment explained above with regard to the operating lever 18 and its overpressure capability. For better clarity, the clamping spring 3 and most of the busbar 4 are not shown in this representation in order to make evident the position of the support surface 39 of the operating element 14, in particular, which forms a carrier for the clamping section 9 or an operating section of the clamping spring 3 formed thereon, corresponding to the operating section 15.

It can also be seen that the spring-loaded terminal can be designed with a contact jack 32 that projects from the insulating housing 2 and has prongs 31*a*, 31*b* that can be formed on the retaining frame 6 of the busbar 4. A contact pin 47 can be inserted into this contact jack 32.

The invention being thus described, it will be obvious that the same may be varied in many ways. Such variations are not to be regarded as a departure from the spirit and scope of the invention, and all such modifications as would be obvious to one skilled in the art are to be included within the scope of the following claims:

What is claimed is:

1. A spring-loaded terminal for clamping an electrical conductor, the spring-loaded terminal comprising:

at least one clamping spring for clamping the electrical conductor onto the spring-loaded terminal; and at least one pivotable operating lever for operating the clamping spring, wherein the operating lever is movable back and forth between an open position, in which a conductor clamping point formed with the clamping spring is open, and a closed position, in which the clamping point is closed, and wherein the spring-loaded terminal has an operating element that is adapted to be operated by the pivotable operating lever and that is designed as a tension member mounted so as to be essentially linearly movable, through which the clamping point is opened via a tensile force acting on the clamping spring when the operating lever is pivoted into the open position.

2. The spring-loaded terminal according to claim 1, further comprising:

an insulating housing;

a busbar;

a clamping spring that has a contact leg, a spring bend, a clamping leg, and an operating section, wherein the clamping leg has a clamping edge, and wherein the clamping edge forms, together with the busbar, a clamping point for clamping the electrical conductor between the clamping edge and the busbar;

an operating element that is movably mounted in the insulating housing and is designed to apply a force to the operating section, wherein the operating element is mounted in the insulating housing so as to be linearly movable, and extends from the operating section of the clamping spring beyond a plane spanned by the support surface of the contact leg on the busbar or by the insulating housing, wherein the operating element is adapted to apply a force to the operating section of the clamping spring on the side of the operating section facing away from the support surface of the contact leg on the busbar.

3. The spring-loaded terminal according to claim 1, wherein the operating lever has a support contour for forming a plain bearing with the support surface of the insulating housing.

4. The spring-loaded terminal according to claim 1, wherein the insulating housing has a support surface for an operating lever, and wherein the operating element has a bearing surface located opposite the support surface of the insulating housing, wherein a free space for receiving a section of the operating lever is present between the support surface of the insulating housing and the bearing surface of the operating element, and wherein the operating lever is an operating tool that is adapted to be inserted into the free space, wherein the support surface and the bearing surface are offset from one another in the direction of extent of the operating tool inserted into the free space.

5. The spring-loaded terminal according to claim 1, wherein the operating lever is oriented to point toward the electrical conductor to be clamped.

6. The spring-loaded terminal according to claim 1, wherein the clamping spring is a leg spring bent into a U-shape, and the operating section of the clamping spring is located at a distance from the clamping edge on the clamping leg or is connected to the clamping leg.

7. The spring-loaded terminal according to claim 1, wherein the operating section of the clamping spring is a frame element that has a side bar connected to the clamping leg and has a crossbar located on the side bar, wherein a clamping tab equipped with the clamping edge projects from the clamping leg next to the side bar, and wherein the crossbar is ahead of or behind the clamping edge in an insertion direction.

8. The spring-loaded terminal according to claim 1, wherein the operating section of the clamping spring is a frame element that has two side bars connected to the clamping leg and spaced apart from one another, and has a crossbar connecting the side bars, wherein a clamping tab equipped with the clamping edge projects from the clamping leg between the side bars, and wherein the crossbar is ahead of or behind the clamping edge in the insertion direction.

9. The spring-loaded terminal according to claim 1, wherein the insulating housing has a recess, and wherein the support surface is located in the recess.

10. The spring-loaded terminal according to claim 1, wherein the contact leg is inserted into a contact opening of the busbar.

11. The spring-loaded terminal according to claim 1, wherein the insulating housing has a surface section that is oriented to hold the operating lever in a position beyond dead center or a rest position, with the clamping point open.

12. The spring-loaded terminal according to claim 1, wherein the operating element has a guide wall extending laterally next to the clamping spring and mounted on the insulating housing so as to be linearly movable, and has a finger extending from the guide wall under the operating section.

13. The spring-loaded terminal according to claim 12, wherein the operating section of the clamping spring is formed on a lug projecting laterally from the clamping leg.

14. The spring-loaded terminal according to claim 13, wherein the crossbar has an additional clamping edge for clamping an electrical conductor.

15. The spring-loaded terminal according to claim 1, wherein an operating lever, which is pivotably mounted on the spring-loaded terminal, is mounted on a bearing section of the operating element, wherein the insulating housing has a support surface for the operating lever, wherein the bearing section and the support surface are matched to one another such that the operating element is adapted to be displaced linearly by pivoting the operating lever that is supported on the support surface of the insulating housing and braced against the bearing section of the operating element.

16. The spring-loaded terminal according to claim 15, wherein a free space for receiving a section of the operating lever is present between the bearing section of the operating element and the support surface of the insulating housing.

17. The spring-loaded terminal according to claim 15, wherein the operating lever is arranged on the operating element with a pivot bearing.

18. The spring-loaded terminal according to claim 17, wherein the operating lever has a lever arm section and a pressure arm section, which each project out from the pivot bearing in different directions from one another.

19. The spring-loaded terminal according to claim 18, wherein the pressure arm section projects in the opposite direction from the lever arm section and extends at an obtuse angle to the longitudinal axis of the lever arm section, which passes through the pivot bearing.

20. The spring-loaded terminal according to claim 18, wherein the pressure arm section and the lever arm section are located on a same side of the pivot bearing, and wherein the pressure arm section extends at an acute angle to the longitudinal axis of the lever arm section, which passes through the pivot bearing.

21. A spring-loaded terminal for clamping an electrical conductor, the spring-loaded terminal comprising:

at least one clamping spring for clamping the electrical conductor onto the spring-loaded terminal; and at least one pivotable operating lever for operating the clamping spring, wherein the operating lever is moveable back and forth between an open position, in which a conductor clamping point formed with the clamping spring is open, and a closed position, in which the clamping point is closed, wherein the open position and the closed position constitute end positions of the pivoting motion of the operating lever at which the operating lever comes to rest against a mechanical stop, and wherein the operating lever is be pivotable beyond at least one of the end positions into an overpressure position without parts of the spring-loaded terminal being damaged or the operating lever detaching from the spring-loaded terminal in the process.

22. The spring-loaded terminal according to claim 21, wherein the operating lever is equipped for linear operation of the operating element.

23. The spring-loaded terminal according to claim 21, wherein the operating element is linearly movable by the motion of the operating lever into at least one overpressure position.

24. The spring-loaded terminal according to claim 21, wherein the operating lever is rotatably mounted on the linearly movable operating element, wherein the operating lever participates in the linear motion of the operating element when the operating lever is moved into the at least one overpressure position.

25. The spring-loaded terminal according to claim 21, wherein the spring-loaded terminal has an overpressure contour formed on the insulating housing or another part of the spring-loaded terminal along which the support contour of the operating lever slides when the operating lever is moved into the overpressure position.

26. The spring-loaded terminal according to claim 21, wherein at least sections of the overpressure contour run at an angle to the direction of linear motion of the operating element.

27. The spring-loaded terminal according to claim 21, wherein the operating force of the operating lever rises when the operating lever is moved from an end position into an overpressure position.

28. The spring-loaded terminal according to claim 21, wherein a material of the lever-side bearing elements has a different melting temperature than a material of the retaining-part-side bearing elements.

29. The spring-loaded terminal according to claim 21, wherein the operating lever is attached to a retaining part of the spring-loaded terminal, or is attached to the operating element and cannot be nondestructively detached therefrom.

30. The spring-loaded terminal according to claim 29, wherein the operating lever is attached to a retaining part of the spring-loaded terminal by a pivot bearing, wherein the operating lever has bearing elements of the pivot bearing on the lever side, wherein the retaining part has bearing elements of the pivot bearing on the retaining part side, and wherein the retaining-part-side bearing elements are molded directly in a positive-locking manner around the lever-side bearing elements or onto the lever-side bearing elements during manufacture.

31. A method for producing a spring-loaded terminal for connecting an electrical conductor, the spring-loaded terminal comprising at least one clamping spring for clamping the electrical conductor onto the spring-loaded terminal and at least one pivotable operating lever for operating the clamping spring that is attached to a retaining part of the spring-loaded terminal by a pivot bearing, the method comprising:

producing the operating lever with lever-side bearing elements of the pivot bearing;

producing the retaining part of the spring-loaded terminal on which the operating lever is mounted in that the retaining part with retaining-part-side bearing elements of the pivot bearing is formed around the lever-side bearing elements of the pivot bearing so that the lever-side bearing elements of the pivot bearing are supported by the retaining-part-side bearing elements of the pivot bearing during the process of producing the retaining part; and completing the spring-loaded terminal with the subassembly formed of the operating lever and the retaining part of the spring-loaded terminal to which the operating lever is attached, and also the remaining elements of the spring-loaded terminal, including the clamping spring.

* * * * *